US006143969A

United States Patent [19]

Lin

[11] Patent Number: 6,143,969

[45] Date of Patent: Nov. 7, 2000

[54] MOUTH-PIPE OF A SAXOPHONE

[76] Inventor: Wei-Fu Lin, 3F,No.8,Lane118,Ming-Teh Rd., Pei-Tou, Taipei, Taiwan

[21] Appl. No.: 09/349,805

[22] Filed: Jul. 12, 1999

[51] Int. Cl.[7] ..... G10D 7/08

[52] U.S. Cl. ..... 84/385 R; 84/380 R; 84/386

[58] Field of Search ..... 84/380 R, 385 R, 84/386, 394, 396

[56] References Cited

U.S. PATENT DOCUMENTS 1,817,487 8/1931 Heyworth et al. ..... 84/385 R

*Primary Examiner*—David Martin
*Assistant Examiner*—Shih-yung Hsieh
*Attorney, Agent, or Firm*—Jacobson, Price, Holman & Stern, PLLC

[57] ABSTRACT

A mouth-pipe of a saxophone is disclosed. A mouth-pipe is covered on a top of a saxophone wind tube. A high pitch hole is installed on the upper end of the mouth-pipe which is pivotally installed with an octave key. A key cover is installed at the inner surface of the upper end of the octave key, and the key cover presses against the high pitch hole of the mouth-pipe. A ring is formed at the lower end of the octave key. A push rod connected to a high pitch key is installed above the saxophone wind tube. If the high pitch key does not press the high pitch hole, a high pitch is emitted; while if the high pitch key is released, a low pitch is emitted; Two long ear seats facing with one another are installed at the pivotal position of the octave key, and a convex point is formed at a lower end of each long ear seat. Two opposite long pivotal seats are placed at the pivotal positions of the mouth-pipe. The outer surface of each long pivotal seat is placed against the inner surface of the respective long ear seat so that the octave key oscillates steadily upwards and downwards, thus the key cover at the upper end of the octave key accurately covers the high pitch hole of the mouth-pipe and the convex point at the lower portion of the long ear seat resists against the mouth-pipe of the long pivotal seat for positioning the opening of key cover at the upper end of the octave key. Therefore, a high pitch is emitted accurately.

1 Claim, 5 Drawing Sheets

MOUTH-PIPE OF A SAXOPHONE

BACKGROUND OF THE INVENTION

1. Field of the Invention

The present invention relates to an improved mouth-pipe of a saxophone, and especially to an octave key of the saxophone which may vibrate steadily so that the key cover may align with the high pitch hole, and the opening of the key cover can be positioned for emitting a high pitch.

2. Description of the Prior Art

The saxophone used in jazz music is primary formed by a saxophone wind tube, a mouth-pipe and a mouth. Wooden pieces are installed on the mouth. By blowing the pieces to vibrate, sounds will be emitted.

A high pitch hole a1 is installed on the mouth-pipe a of a saxophone and a tube seat a2 is installed on the mouth-pipe a. Further, an ear seat b1 is installed at two sides of the middle portion of the octave key b. Therefore, the octave key b may be pivotally installed to a tube seat a2 of the mouth-pipe a through the ear seat b1. An elastic piece c is installed at the lower end of the pivotal seat of the octave key b. The distal end of the elastic piece c resists against the mouth-pipe a. A key cover b2 is installed within the upper end of the octave key b which presses against the high pitch hole a1 of the mouth-pipe a. A guide seat a3 is installed in front of the high pitch hole a1. Thus, the upper end of the octave key b may resist against the guide seat a3 and the key cover b2 thus presses against the high pitch hole a1. Moreover, the octave key b has a ring b3 at the lower end thereof. The ring b3 covers the lower end of the mouth-pipe a. A push rod d2 connected to a high pitch key d1 is installed at upper end of the saxophone wind tube d. The push rod d2 resists against the inner rim of the ring b3 of the octave key b, as shown in FIGS. 6 and 7. An opposite arrangement of the tube seat a2 and ear seat b1 is shown in FIGS. 8 and 9. Thus, by clicking the high pitch key, the octave key b, will be driven by the push rod d2, thus the key cover b2 above the octave key b will not resist against the high pitch hole a1 of the mouth-pipe a so that a high pitch is emitted. If the high pitch key d1 is released, than the octave key b will restore to the original place by the elastic piece c and the key cover b2 of the octave key b will resist against the high pitch hole a1 of the mouth-pipe a for emitting a low pitch.

The two ear seats b1 of the octave key b resists against the two ends of the tube seat a2 of the mouth-pipe a and a pin penetrates therethrough to pivotally install the octave key b to the mouth-pipe a. Since the contact area between the two ends of tube seat a2 and the ear seat b1 is smaller, and a gap exists between the ear seat b1 and two ends of the tube seat a2, thus, a vibration will induced as the octave key b oscillates upwards and downwards. Thus, the key cover b2 above the octave key b can not accurately resist against the high pitch hole a1 of the mouth-pipe a. Therefore, the high pitch hole will vent air and the tone become inaccurate. Therefore, noise occurs.

Moreover, as the high pitch key d2 on the saxophone wind tube d is pressed, the octave key b will be pushed and move upwards. As a result, when the key cover b2 separates with the high pitch hole a1 of the mouth-pipe a, since the opening between the key cover b2 and the high pitch hole a1 will effect the tone of sound. A larger opening will induce a low gamut, while a smaller opening induces a high gamut. While if the octave key in the prior art is pushed away, the opening thereof can not be controlled, so that the opening of the key cover b2 varies, and the tone is thus unsteadily.

Furthermore, when the octave key b vibrates, a guide seat a3 of the mouth-pipe a serves to correct the position thereof to avoid position shifts of the octave key b. Therefore, a more guide seat a3 is necessary, this increases the cost.

SUMMARY OF THE INVENTION

Accordingly, the object of the present invention is to provide an improved mouth-pipe of a saxophone with an octave key. The octave key vibrates steadily so that the key cover may cover the high pitch hole accurately in order to prevent that air flows out and the tone is thus inaccurately.

Another object of the present invention is to provide an improved mouth-pipe of a saxophone with a convex point at the lower end of a long ear seat of the octave key. The convex point resists against the mouth-pipe at the outer side of the long pivotal seat for positioning the opening at the upper end of the octave key so that a high pitch is emitted accurately.

Another object of the present invention is to provide an improved mouth-pipe of a saxophone without needing a guide seat.

In order to achieve above objects, the present invention provides a mouth-pipe of a saxophone. A mouth-pipe covers the top of a saxophone wind tube. A high pitch hole is installed on the upper end of the mouth-pipe which is pivotally installed with an octave key. A key cover is installed at the inner surface of the upper end of the octave key, the key cover presses against the high pitch hole of the mouth-pipe. A ring is formed at the lower end of the octave key. A push rod connected to a high pitch key is installed above the saxophone wind tube. If the high pitch key does not press the high pitch hole, a high pitch is emitted; if the high pitch key is released, a low pitch is emitted. Characterized in that: two long ear seats facing with one another are installed at the pivotal position of the octave key, and a convex point is formed at a lower end of each long ear seat. Two opposite long pivotal seats are placed at the pivotal positions of the mouth-pipe. The outer surface of each long pivotal seat is placed against the inner surface of the respective long ear seat so that the octave key oscillates steadily upwards and downwards, thus the key cover at the upper end of the octave key accurately covers the high pitch hole of the mouth-pipe and the convex point at the lower portion of the long ear seat resists against the mouth-pipe of the long pivotal seat for positioning the opening of key cover are the upper end of the octave key. Therefore, a high pitch is emitted accurately.

The present invention will be better understood and its numerous objects and advantages will become apparent to those skilled in the art by referencing to the following drawings in which:

DETAILED DESCRIPTION OF THE PREFERRED EMBODIMENT

Figure 1:
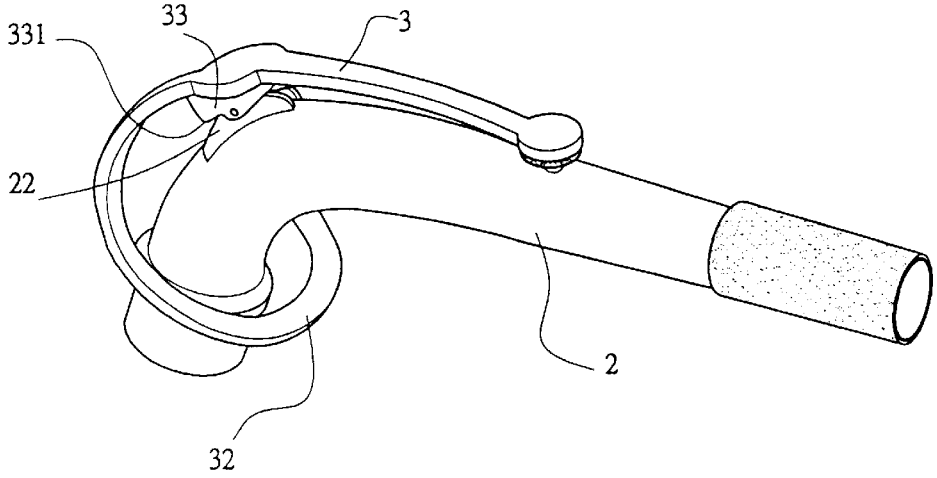
FIG. 1 is a perspective view of the present invention.
Figure 2:
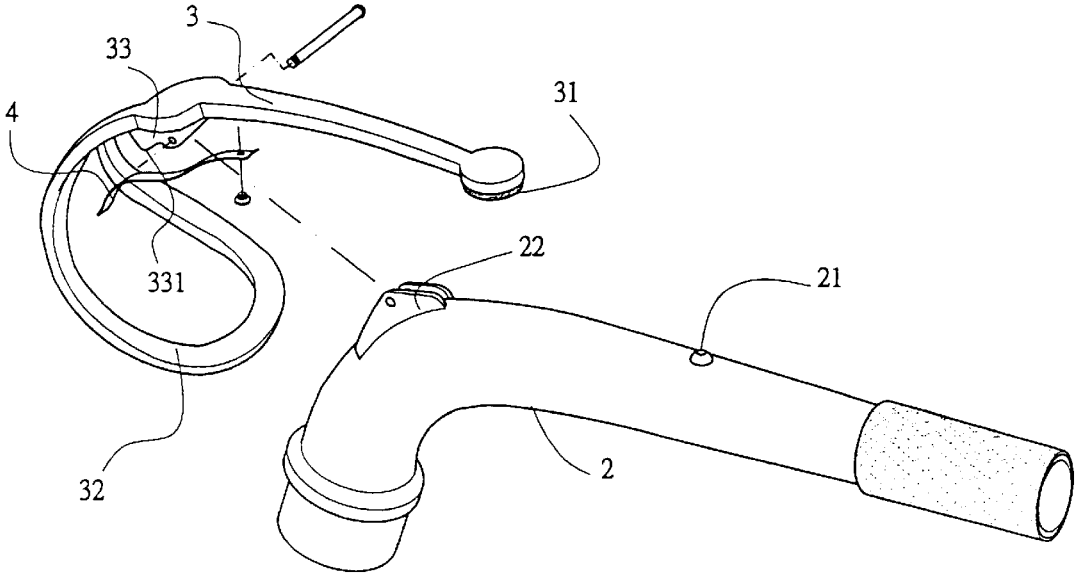
FIG. 2 is an exploded perspective view of the present invention.

With reference to FIGS. 1 and 2, in the present invention, a mouth-pipe 2 covers the top of a saxophone wind tube 1.

Figure 3:
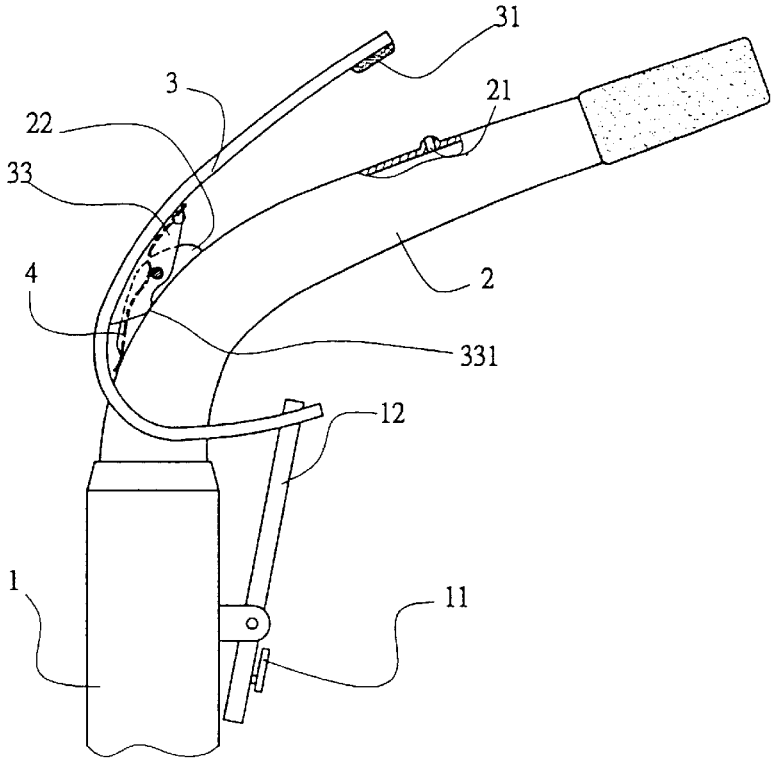
FIG. 3 shows the action for emitting a high pitch as the key cover is far away from a high pitch hole.
Figure 4:
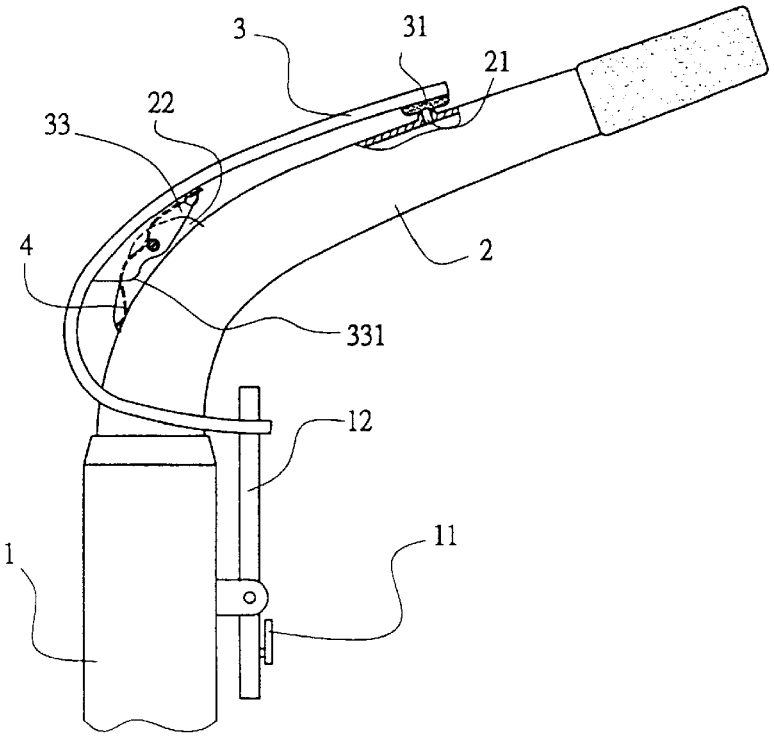
FIG. 4 shows the action for emitting a low pitch as the key cover covers a high pitch hole.

A high pitch hole 21 is installed on the upper end of the mouth-pipe 2 which is pivotally installed with an octave key 3. An elastic piece 4 is installed below the octave key 3. While, the distal end of the elastic piece 4 resists against the mouth-pipe 2. Another, a key cover 31 is installed at the inner surface of the upper end of the octave key 3. The key cover 3 presses against the high pitch hole 21 of the mouth-pipe 2. A ring 32 is formed at the lower end of the octave key 3. The ring 32 covers the lower end of the mouth-pipe 2. A push rod 12 connected to a high pitch key 11 is installed above the saxophone wind tube 1. Thus, if the high pitch key is clicked, the push rod 12 will push the octave key 3. Thus, the key cover 21 on the upper end of the octave key 3 will not press against the high pitch hole 21 of the mouth-pipe 2 for emitting a high pitch, as shown in FIG. 3. If the high pitch key 11 is released, the octave key 3 will restore to the original position by the elastic piece 4 and the key cover 31 on the octave key 3 will press against the high pitch hole 21 of the mouth-pipe 2 so as to emit a low pitch, as shown in FIG. 4.

Two long ear seats 33 facing with one another are installed at the pivotal position of the octave key 3, and a convex point 331 is formed at the lower end of each long ear seat 33. Two opposite long pivotal seats 22 are placed at the pivotal positions of the mouth-pipe 2. The outer surface of the long pivotal seat 22 is placed against the inner surface of the long ear seat 33 so that the octave key 3 may oscillate steadily upwards and downwards. As a result, the key cover 31 at the upper end of the octave key 3 accurately covers the high pitch hole 21 of the mouth-pipe 2, and the convex point 33 at the lower portion of the long ear seat 33 resists against the mouth-pipe 2 of the long pivotal seat 22 for positioning the opening of key cover 31 at the upper end of the octave key 3. Therefore, a high pitch can be emitted accurately.

According to aforementioned structure, since the long ear seat 33 of the octave key 3 has a larger contact area with the long pivotal seat 22 of the mouth-pipe 2, thus, the octave key 3 can oscillate steadily. The key cover 31 at the upper end of the octave key 3 may accurately cover the high pitch 21 of the mouth-pipe 2. Thus, an inaccurate tone due to air discharging is avoided. Besides, noise is avoided and the saxophone emits a preferred tone.

Further, by the upward and downward oscillations of the octave key 3, the key cover 31 may cover the high pitch hole 21 of the mouth-pipe. When, a high gamut or a low gamut is emitted, the convex point 331 at the lower end of the long ear seat 33 of octave key 3 resists against the mouth-pipe 2 at outer side of the long pivotal seat 22. Therefore, the opening of the key cover 31 at upper portion of the octave key 3 is positioned so that an accurate high pitch is emitted accurately, as shown in FIG. 3. Therefore, a preferred tone is obtained.

Figure 5:
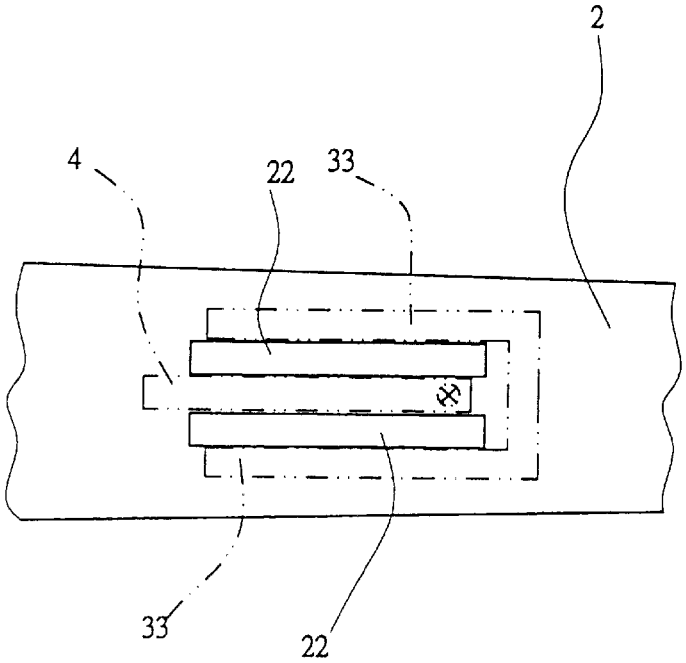
FIG. 5 shows the assembling of the present invention.
Figure 6:
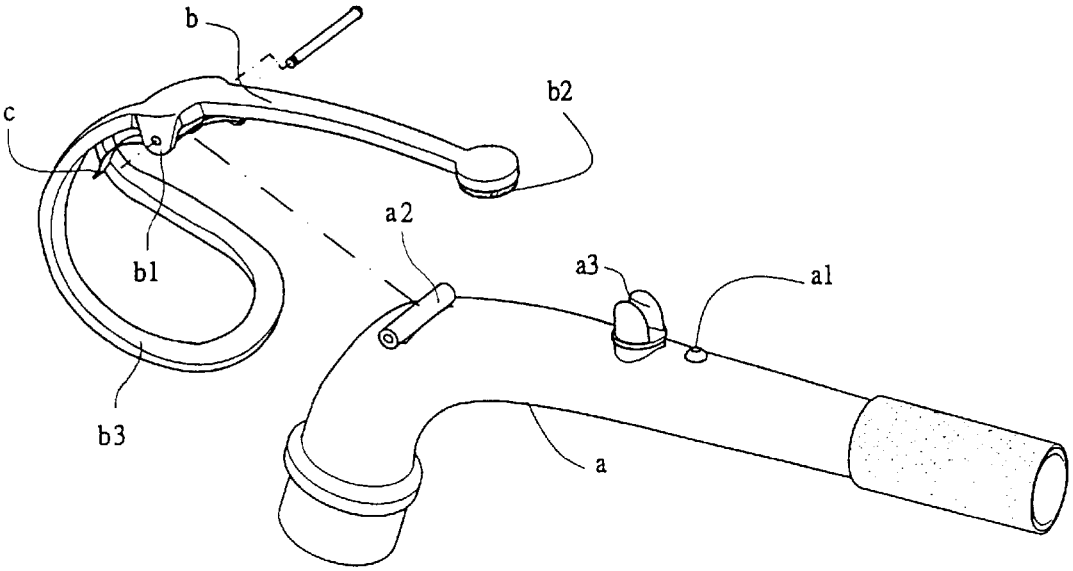
FIG.6 (PRIOR ART)
FIG. 6 is an exploded perspective view of the prior art.
Figure 7:
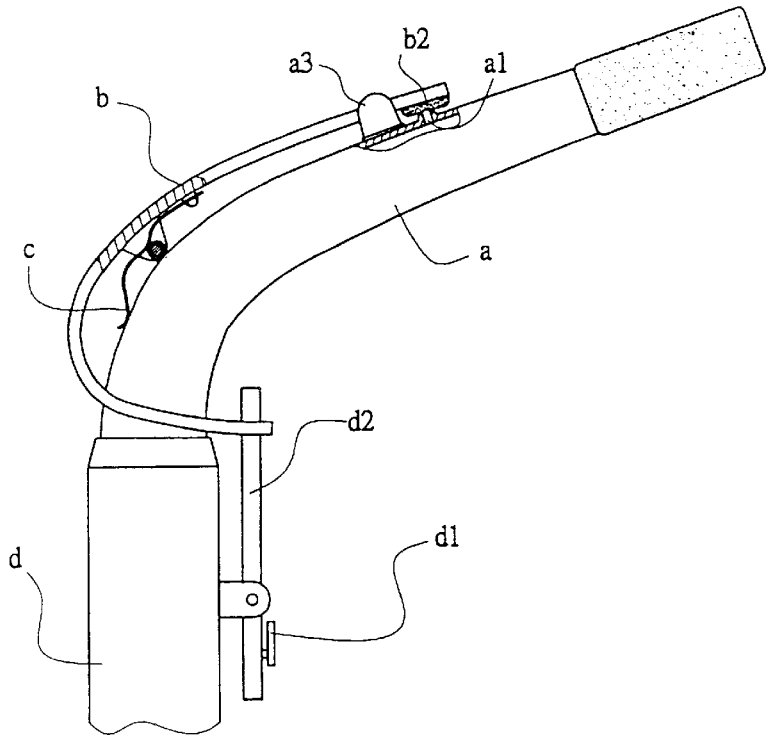
FIG.7 (PRIOR ART)
FIG. 7 is a side view of FIG. 6.
Figure 8:
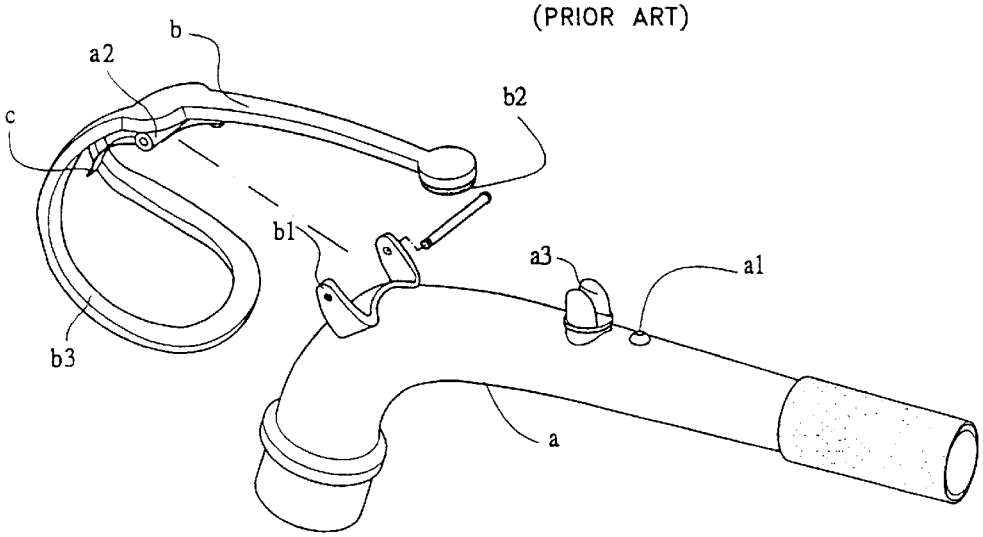
FIG.8 (PRIOR ART)
FIG. 8 is an exploded perspective view of the prior art.
Figure 9:
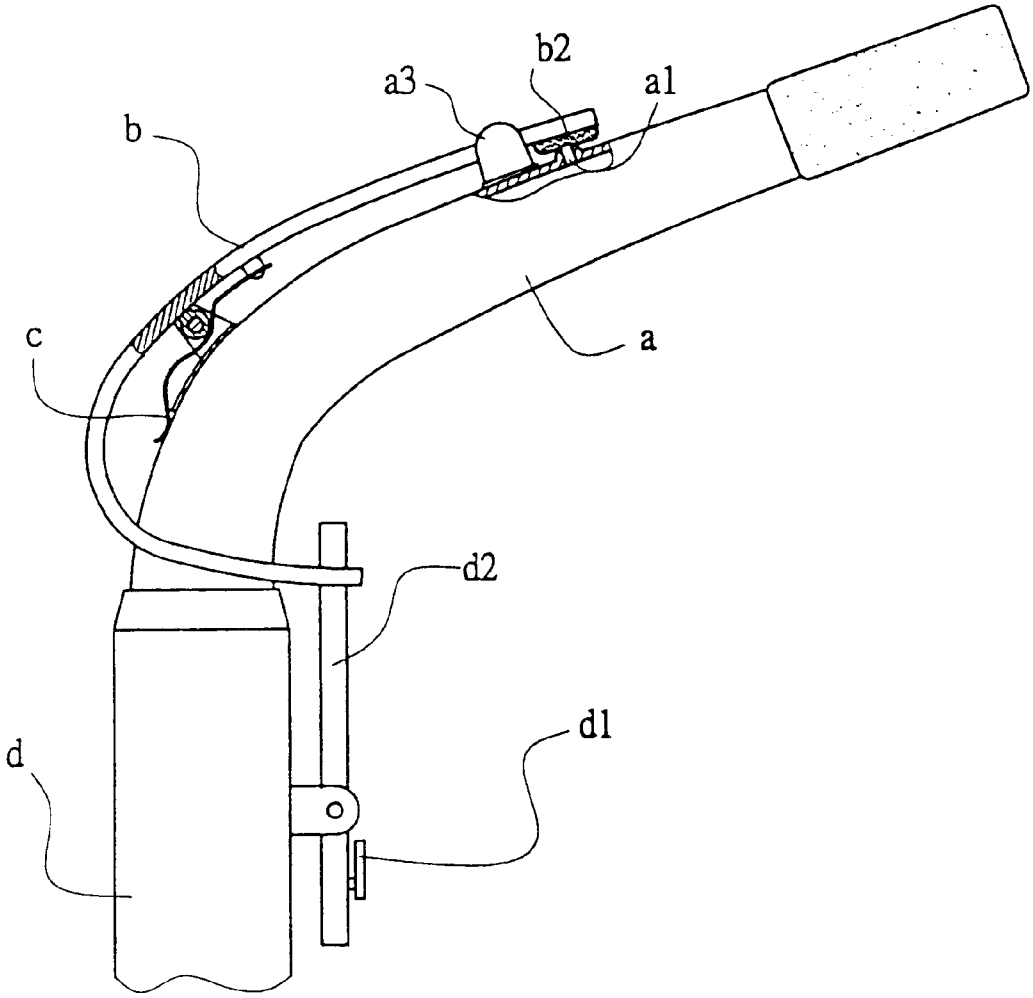
FIG.9 (PRIOR ART)
FIG. 9 is a side view of FIG. 8.

Since the long ear seat 33 of the octave key 3 has a larger contact surface with the long pivotal seat 22 of the mouth-pipe 2, as shown in FIG. 5, the octave key 3 can vibrate steadily upwards and downwards. Thus, a guide seat used in the prior art is unnecessary and the cost is thus reduced.

Although the present invention has been described using specified embodiment, the examples are meant to be illustrative and not restrictive. It is clear that many other variations would be possible without departing from the basic approach, demonstrated in the present invention.

What is claimed is:

1. A mouth-pipe for a saxophone wind tube comprising:

a high pitch key connected with a push rod, said high pitch key being pivotally mounted on said wind tube;

an octave key having a key cover for pressing a high pitch hole located on an upper end of said mouth-pipe, said octave key being pivotally mounted on said mouth pipe;

an elastic piece mounted below said octave key;

engagement means for said high pitch key to engage said octave key;

two long ear seats facing with one another mounted at a pivotal position of said octave key, each of said long ear seats having an inner surface and a convex portion at a lower end;

two long pivotal seats mounted on said mouth-pipe, each of said two long pivotal seats having an outer surface;

said outer surface of each of said long pivotal seats being placed against said respective inner surface of each of said long ear seats for steady upward and downward octave key vibrations.

* * * * *